US008317359B2

(12) United States Patent
Harbers et al.

(10) Patent No.: US 8,317,359 B2
(45) Date of Patent: Nov. 27, 2012

(54) ILLUMINATION DEVICE WITH LIGHT EMITTING DIODES AND MOVEABLE LIGHT ADJUSTMENT MEMBER

(75) Inventors: Gerard Harbers, Sunnyvale, CA (US); Mark A. Pugh, Los Gatos, CA (US); Menne T. de Roos, Saratoga, CA (US); John S. Yriberri, Los Gatos, CA (US); Peter K. Tseng, San Jose, CA (US)

(73) Assignee: Xicato, Inc., San Jose, CA (US)

( * ) Notice: Subject to any disclaimer, the term of this patent is extended or adjusted under 35 U.S.C. 154(b) by 0 days.

(21) Appl. No.: 13/166,767

(22) Filed: Jun. 22, 2011

(65) Prior Publication Data

US 2011/0249433 A1 Oct. 13, 2011

Related U.S. Application Data

(62) Division of application No. 12/249,892, filed on Oct. 10, 2008, now Pat. No. 7,984,999.

(60) Provisional application No. 61/062,223, filed on Jan. 23, 2008, provisional application No. 60/999,496, filed on Oct. 17, 2007.

(51) Int. Cl.
*F21V 9/00* (2006.01)

(52) U.S. Cl. ..... 362/231; 362/230; 362/293

(58) Field of Classification Search ..... 362/231, 362/230, 293

See application file for complete search history.

(56) References Cited

U.S. PATENT DOCUMENTS 3,564,233 A 2/1971 Cox et al.
3,593,055 A 7/1971 Geusic et al.
5,959,316 A 9/1999 Lowery
5,962,971 A 10/1999 Chen
5,966,393 A 10/1999 Hide et al.
5,982,092 A 11/1999 Chen
5,998,925 A 12/1999 Shimizu et al.
6,066,861 A 5/2000 Hohn et al.

(Continued)

FOREIGN PATENT DOCUMENTS

EP 0 890 996 A2 1/1999

(Continued)

OTHER PUBLICATIONS

International Preliminary Report on Patentability mailed on Apr. 20, 2010, for International Application No. PCT/US2008/079823 filed on Oct. 14, 2008, by Xicato, Inc., 11 pages.

(Continued)

*Primary Examiner* — Evan Dzierzynski

(74) *Attorney, Agent, or Firm* — Silicon Valley Patent Group LLP

(57) ABSTRACT

A light emitting device is produced using one or more light emitting diodes within a light mixing cavity formed by surrounding sidewalls. The light emitting device includes a light adjustment member that is movable to alter the shape or color of the light produced by the light emitting device. For example, the light adjustment member may alter the exposure of the wavelength converting area to the light emitted that is emitted by the light emitting diode in the light mixing cavity. Alternatively, the height of a lens may be adjusted to change the width of the beam produced. Alternatively, a movable substrate with areas of different wavelength converting materials may adjustably cover the output port of the light mixing cavity to alter the color point of the light produced.

17 Claims, 11 Drawing Sheets

U.S. PATENT DOCUMENTS

| | | | | |
|---|---|---|---|---|
| 6,068,383 | A | 5/2000 | Robertson et al. | |
| 6,220,725 | B1 | 4/2001 | Arnold | |
| 6,234,648 | B1 | 5/2001 | Borner et al. | |
| 6,340,824 | B1 | 1/2002 | Komoto et al. | |
| 6,351,069 | B1 | 2/2002 | Lowery et al. | |
| 6,469,322 | B1 | 10/2002 | Srivastava et al. | |
| 6,504,301 | B1 | 1/2003 | Lowery et al. | |
| 6,576,930 | B2 | 6/2003 | Reeh et al. | |
| 6,586,882 | B1 | 7/2003 | Harbers | |
| 6,600,175 | B1 | 7/2003 | Baretz et al. | |
| 6,621,211 | B1 | 9/2003 | Srivastava et al. | |
| 6,649,946 | B2 | 11/2003 | Bogner et al. | |
| 6,680,569 | B2 | 1/2004 | Mueller-Mach et al. | |
| 6,724,142 | B2 | 4/2004 | Ellens et al. | |
| 6,765,237 | B1 | 7/2004 | Doxsee et al. | |
| 6,791,259 | B1 | 9/2004 | Stokes et al. | |
| 6,812,500 | B2 | 11/2004 | Reeh et al. | |
| 6,850,002 | B2 | 2/2005 | Danielson et al. | |
| 7,048,408 | B2 | 5/2006 | Dallas et al. | |
| 7,126,162 | B2 | 10/2006 | Reeh et al. | |
| 7,246,926 | B2 | 7/2007 | Harwood | |
| 7,250,715 | B2 | 7/2007 | Mueller et al. | |
| 7,479,662 | B2 | 1/2009 | Soules et al. | |
| 7,494,246 | B2 | 2/2009 | Harbers | |
| 7,534,002 | B2 | 5/2009 | Yamaguchi et al. | |
| 7,537,360 | B2 | 5/2009 | Allegri | |
| 7,564,180 | B2 | 7/2009 | Brandes | |
| 7,614,759 | B2 | 11/2009 | Negley | |
| 7,629,621 | B2 | 12/2009 | Reeh et al. | |
| 7,651,243 | B2 | 1/2010 | McGuire et al. | |
| 7,942,556 | B2 | 5/2011 | Harbers et al. | |
| 7,984,999 | B2 | 7/2011 | Harbers et al. | |
| 2002/0043926 | A1 | 4/2002 | Takahashi et al. | |
| 2003/0137844 | A1 | 7/2003 | Bucher et al. | |
| 2005/0057145 | A1 | 3/2005 | Shieh et al. | |
| 2005/0185417 | A1* | 8/2005 | Mayer et al. | 362/555 |
| 2006/0023444 | A1 | 2/2006 | Dallas et al. | |
| 2006/0087487 | A1 | 4/2006 | Ota | |
| 2006/0087847 | A1* | 4/2006 | Yamanaka | 362/277 |
| 2006/0091411 | A1 | 5/2006 | Ouderkirk et al. | |
| 2007/0019408 | A1 | 1/2007 | McGuire et al. | |
| 2007/0047227 | A1 | 3/2007 | Ducharme | |
| 2007/0081336 | A1 | 4/2007 | Bierhuizen et al. | |
| 2007/0190747 | A1 | 8/2007 | Humpston et al. | |
| 2007/0263393 | A1 | 11/2007 | Van De Ven | |
| 2008/0142816 | A1 | 6/2008 | Bierhuizen et al. | |
| 2008/0291670 | A1* | 11/2008 | Rains | 362/231 |
| 2009/0103296 | A1 | 4/2009 | Harbers et al. | |
| 2010/0127282 | A1 | 5/2010 | Harbers et al. | |
| 2010/0290226 | A1 | 11/2010 | Harbers et al. | |
| 2010/0295442 | A1 | 11/2010 | Harbers et al. | |

FOREIGN PATENT DOCUMENTS

| | | |
|---|---|---|
| WO | WO 00/19546 | 4/2000 |
| WO | WO 2005/105381 | 11/2005 |
| WO | WO 2008/149250 | 12/2008 |
| WO | WO 2009/052099 | 4/2009 |

OTHER PUBLICATIONS

Invitation to Pay Additional Fees and Partial Search Report mailed on Jan. 28, 2009, for International Application No. PCT/US2008/079823 filed on Oct. 14, 2008, by Xicato, Inc., 9 pages.

International Search Report and Written Opinion mailed on Mar. 25, 2009, for International Application No. PCT/US2008/079823 filed on Oct. 14, 2008, by Xicato, Inc., 22 pages.

* cited by examiner

ILLUMINATION DEVICE WITH LIGHT EMITTING DIODES AND MOVEABLE LIGHT ADJUSTMENT MEMBER

CROSS REFERENCE TO RELATED APPLICATIONS

This application is a divisional of U.S. patent application Ser. No. 12/249,892 filed Oct. 10, 2008, which application claims the benefit of Provisional Application Nos. 60/999,496 and 61/062,223, filed Oct. 17, 2007, and Jan. 23, 2008, respectively, all of which are incorporated by reference herein in their entirety.

FIELD OF THE INVENTION

This invention relates generally to the field of general illumination, and more specifically, to illumination devices using light emitting diodes (LEDs).

BACKGROUND

The use of light emitting diodes in general lighting is still limited due to limitations in light output level or flux generated by the illumination devices due to the limited maximum temperature of the LED chip, and the life time requirements, which are strongly related to the temperature of the LED chip. The temperature of the LED chip is determined by the cooling capacity in the system, and the power efficiency of the device (optical power produced by the LEDs and LED system, versus the electrical power going in). Illumination devices that use LEDs also typically suffer from poor color quality characterized by color point instability. The color point instability varies over time as well as from part to part. Poor color quality is also characterized by poor color rendering, which is due to the spectrum produced by the LED light sources having bands with no or little power. Further, illumination devices that use LEDs typically have spatial and/or angular variations in the color. Additionally, illumination devices that use LEDs are expensive due to, among other things, the necessity of required color control electronics and/or sensors to maintain the color point of the light source or using only a selection of LEDs produced, which meet the color and/or flux requirements for the application at the time the LEDs are selected.

Consequently, improvements to illumination devices that uses light emitting diodes as the light source are desired.

SUMMARY

A light emitting device is produced using one or more light emitting diodes within a light mixing cavity formed by surrounding sidewalls. One or more wavelength converting materials, such as phosphors, are located at different locations of the cavity. For example, patterns may be formed using multiple phosphors on the sidewalls or a central reflector. Additionally, one or more phosphors may be located on a window that covers the output port of the illumination device. The light emitting device includes a light adjustment member that is movable to alter the shape or color of the light produced by the light emitting device. For example, the light adjustment member may alter the exposure of the wavelength converting area to the light emitted by the light emitting diode in the light mixing cavity. Alternatively, the height of a lens, i.e., the distance from the LEDs to the aperture lens, may be adjusted to change the width of the beam produced. Alternatively, a movable substrate with areas of different wavelength converting materials may adjustably cover the output port of the light mixing cavity to alter the color point of the light produced.

DETAILED DESCRIPTION

Figure 1:
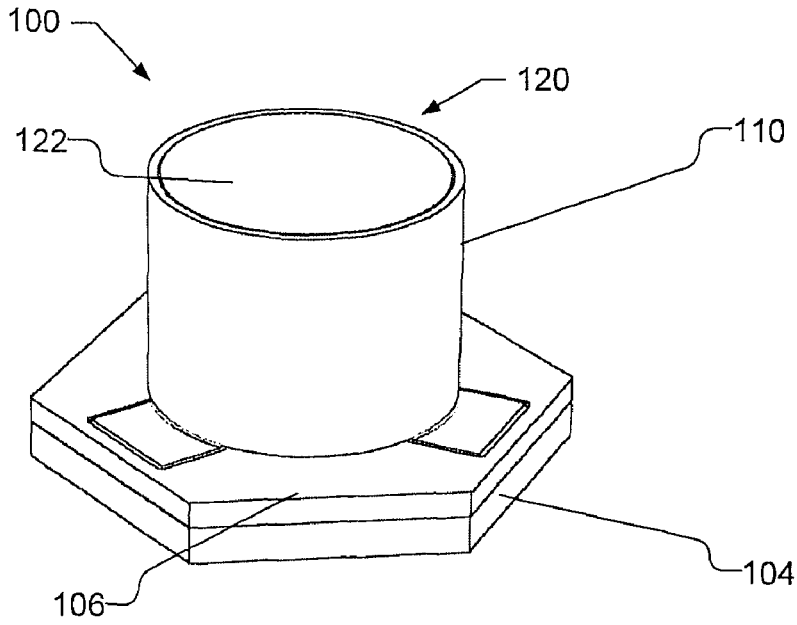
FIGS. 1 and 2 illustrate perspective views of an embodiment of a illumination device that uses light emitting diodes (LEDs) as a light source.
Figure 2:
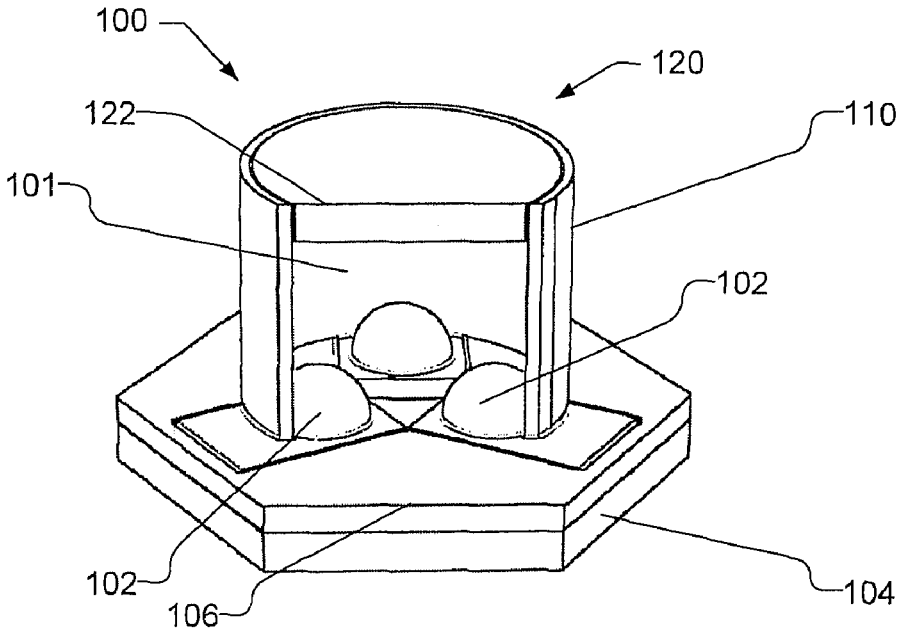
Figure 3:
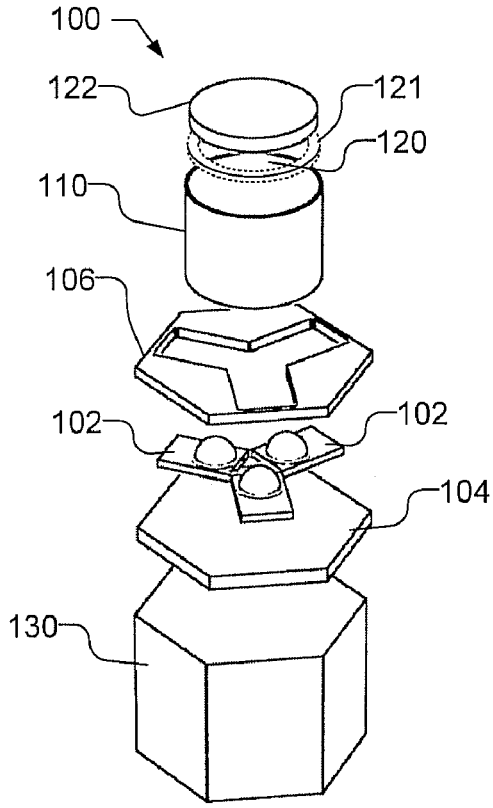
FIG. 3 illustrates a perspective exploded view of the illumination device.

FIGS. 1 and 2 illustrate perspective views of an embodiment of a light emitting diode (LED) illumination device 100 that may include a movable light adjustment member, where FIG. 2 shows a cut-away view illustrating inside of the LED illumination device 100. It should be understood that as defined herein an LED illumination device is not an LED, but is an LED light source or fixture or component part of an LED light source or fixture and that contains an LED board, which includes one or more LED die or packaged LEDs. FIG. 3 illustrates a perspective, exploded view of the illumination device 100. The LED illumination device 100 may be similar to the devices described in U.S. Ser. No. 12/249,874, entitled "Illumination Device with Light Emitting Diodes", by Gerard Harbers et al., filed on Oct. 10, 2008, which is co-owned with the present disclosure and the entirety of which is incorporated hereby by reference.

The illumination device 100 includes one or more solid state light emitting elements, such as light emitting diodes (LEDs) 102 mounted on a board 104 that is attached to or combined with a heat spreader or heat sink 130 (shown in FIG. 3). The board 104 may include a reflective top surface or a reflective plate 106 attached to the top surface of the board 104. The reflective plate 106 may be made from a material with high thermal conductivity and may be placed in thermal contact with the board 104. The illumination device 100 further includes reflective side walls 110 that are coupled to the board 104. The side walls 110 and board 104 with the reflective plate 106 define a cavity 101 in the illumination device 100 in which light from the LEDs 102 is reflected until it exits through an output port 120, although a portion of the light may be absorbed in the cavity. Reflecting the light within the cavity 101 prior to exiting the output port 120 has the effect of mixing the light and providing a more uniform distribution of the light that is emitted from the illumination device 100.

The reflective side walls 110 may be made with highly thermally conductive material, such as an aluminum based material that is processed to make the material highly reflective and durable. By way of example, a material referred to as Miro®, manufactured by Alanod, a German company, may be used as the side walls 110. The high reflectivity of the side walls 110 can either be achieved by polishing the aluminum, or by covering the inside surface of the side walls 110 with one or more reflective coatings. If desired, the reflective surface of the side walls 110 may be achieved using a separate insert that is placed inside a heat sink, where the insert is made of a highly reflective material. By way of example, the insert can be placed into the heat sink from the top or the bottom (before mounting the side wall 110 to the board 106), depending on the side wall section having a larger opening at the top or bottom. The inside of the side wall 110 can either be specular reflective, or diffuse reflective. An example of a highly specular reflective coating is a silver mirror, with a transparent layer protecting the silver layer from oxidation. Examples of highly diffuse reflective coatings are coatings containing titanium dioxide (TiO2), zinc oxide (ZnO), and barium sulfate (BaSO4) particles, or a combination of these materials. In one embodiment, the side wall 110 of the cavity 101 may be coated with a base layer of white paint, which may contain TiO2, ZnO, or BaSO4 particles, or a combination of these materials. An overcoat layer that contains a wavelength converting material, such as phosphor or luminescent dyes may be used, which will be generally referred to herein as phosphor for the sake of simplicity. By way of example, phosphor that may be used include $Y_3Al_5O_{12}$:Ce, $(Y,Gd)_3Al_5O_{12}$:Ce, CaS:Eu, SrS:Eu, $SrGa_2S4$:Eu, $Ca_3(Sc,Mg)_2Si_3O_{12}$:Ce, $Ca_3Sc_2Si_3O_{12}$:Ce, $Ca_3Sc_2O_4$:Ce, $Ba_3Si_6O_{12}N_2$:Eu, (Sr,Ca)$AlSiN_3$:Eu, $CaAlSiN_3$:Eu. Alternatively, the phosphor material may be applied directly to the side walls, i.e., without a base coat.

The reflective side walls 110 may define the output port 120 through which light exits the illumination device 100. In another embodiment, a reflective top 121 that is mounted on top of the reflective side walls 110 may be used to define the output port 120, as illustrated with broken lines in FIG. 3. The output port 120 may include a window 122, which may be transparent or translucent to scatter the light as it exits. The window 122 may be manufactured from an acrylic material that includes scattering particles, e.g., made from TiO2, ZnO, or BaSO4, or other material that have low absorption over the full visible spectrum. In another embodiment, the window 122 may be a transparent or translucent plate with a microstructure on one or both sides. By way of example, the microstructure may be a lenslet array, or a holographic microstructure. Alternatively, the window 122 may be manufactured from $AlO_2$, either in crystalline form (Sapphire) or on ceramic form (Alumina), which is advantageous because of its hardness (scratch resistance), and high thermal conductivity. The thickness of the window may be between e.g., 0.5 and 1.5 mm. If desired, the window may have diffusing properties. Ground sapphire disks have good optical diffusing properties and do not require polishing. Alternatively, the diffuse window may be sand or bead blasted windows or plastic diffusers, which are made diffuse by dispersing scattering particles into the material during molding, or by surface texturing the molds. Additionally, the window 122 may include wavelength converting material, such as phosphor, either incorporated in the window 122 or coating the top and/or bottom surfaces of the window 122.

The cavity 101 may be filled with a non-solid material, such as air or an inert gas, so that the LEDs 102 emit light into the non-solid material as opposed to into a solid encapsulent material. By way of example, the cavity may be hermetically sealed and Argon gas used to fill the cavity. Alternatively, Nitrogen may be used.

While the side walls 110 are illustrated in FIGS. 1 and 2 as having a continuous circular tubular configuration, other configurations may be used. For example, the side walls may be formed from a single continuous side wall in an elliptical configuration (which includes a circular configuration), or multiple side walls may be used to form a discontinuous configuration, e.g., triangle, square, or other polygonal shape (for the sake of simplicity, side walls will be generally referred to herein in the plural). Moreover, if desired, the side walls may include continuous and discontinuous portions. Further, the cavity 101 defined by the side walls 110 may be beveled so that there are differently sized cross-sectional areas at the bottom (i.e., near the LEDs 102) and at the top (near the output port 120).

The board 104 provides electrical connections to the attached LEDs 102 to a power supply (not shown). Additionally, the board 104 conducts heat generated by the LEDs 102 to the sides of the board and the bottom of the board 104, which may be thermally coupled to a heat sink 130 (shown in FIG. 3), or a lighting fixture and/or other mechanisms to dissipate the heat, such as a fan. In some embodiments, the board 104 conducts heat to a heat sink thermally coupled to the top of the board 104, e.g., surrounding side walls 110.

The LED board 104 is a board upon which is mounted one or more LED die or packaged LEDs. The board may be an FR4 board, e.g., that is 0.5 mm thick, with relatively thick copper layers, e.g., 30 μm to 100 μm, on the top and bottom surfaces that serve as thermal contact areas. The board 104 may also include thermal vias. Alternatively, the board 104 may be a metal core printed circuit board (PCB) or a ceramic submount with appropriate electrical connections. Other types of boards may be used, such as those made of alumina (aluminum oxide in ceramic form), or aluminum nitride (also in ceramic form). The side walls 110 may be thermally coupled to the board 104 to provide additional heat sinking area.

The reflective plate 106 may be mounted on the top surface of the board 104, around the LEDs 102. The reflective plate 106 may be highly reflective so that light reflecting downward in the cavity 101 is reflected back generally towards the output port 120. Additionally, the reflective plate 106 may have a high thermal conductivity, such that it acts as an additional heat spreader. By way of example, the reflective plate 106 may be manufactured from a material including enhanced Aluminum, such as a Miro®, manufactured by Alanod. The reflective plate 106 may not include a center piece between the LEDs 102, but if desired, e.g., where a large number of LEDs 102 are used, the reflective plate 106 may include a portion between the LEDs 102 or alternatively a central diverter, such as that illustrated in FIGS. 7A, 7B, and 12A, which may serve as the light adjustment member. The thickness of the reflective plate 106 may be approximately the same thickness as the submounts of the LEDs 102 or slightly thicker. The reflective plate might alternatively be made from a highly reflective thin material, such as Vikuiti™ ESR, as sold by 3M (USA), which has a thickness of 65 μm, in which holes are punched at the light output areas of the LEDs, and which is mounted over the LEDs, and the rest of the board 104. The side walls 110 and the reflective plate 106 may be thermally coupled and may be produced as one piece if desired. The reflective plate 106 may be mounted to the board 104, e.g., using a thermal conductive paste or tape. In another embodiment, the top surface of the board 104 itself is configured to be highly reflective, so as to obviate the need for the reflective plate 106. Alternatively, a reflective coating might be applied to board 104, the coating composed of white particles e.g. made from TiO2, ZnO, or BaSO4 immersed in a transparent binder such as an epoxy, silicone, acrylic, or N-Methylpyrrolidone (NMP) materials. Alternatively, the coating might be made from a phosphor material such as YAG:Ce. The coating of phosphor material and/or the TiO2, ZnO or BaSO4 material may be applied directly to the board 104 or to, e.g., the reflective plate 106, for example, by screen printing. Typically in screen printing small dots are deposited. The dots might be varied in size and spatial distribution to achieve a more uniform or more peaked luminance distribution over the window 122, to facilitate either more uniform or more peaked illumination patterns in the beam produced.

As illustrated in FIGS. 1 and 2, multiple LEDs 102 may be used in the illumination device 100. The LEDs 102 are positioned rotationally symmetrically around the optical axis of the illumination device 100, which extends from the center of the cavity 101 at the reflective plate 106 (or board 104) to the center of the output port 110, so that the light emitting surfaces or p-n junctions of the LEDs are equidistant from the optical axis. The illumination device 100 may have more or fewer LEDs, but six (6) to ten (10) LEDs has been found to be a useful quantity of LEDs 102. In one embodiment, twelve (12) or fourteen (14) LEDs are used. When a large number of LEDs is used, it may be desirable to combine the LEDs into multiple strings, e.g., two strings of six (6) or seven (7) LEDs, in order to maintain a relatively low forward voltage and current, e.g., no more than 36V and 700 mA. If desired, a larger number of the LEDs may be placed in series, but such a configuration may lead to electrical safety issues.

In one embodiment, the LEDs 102 are packaged LEDs, such as the Luxeon Rebel manufactured by Philips Lumileds Lighting. Other types of packaged LEDs may also be used, such as those manufactured by OSRAM (Ostar package), Luminus Devices (USA), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LEDs 102 may include a lens over the LED chips. Alternatively, LEDs without a lens may be used. LEDs without lenses may include protective layers, which may include phosphors. The phosphors can be applied as a dispersion in a binder, or applied as a separate plate. Each LED 102 includes at least one LED chip or die, which may be mounted on a submount. The LED chip typically has a size about 1 mm by 1 mm with a thickness of approximately 0.01 mm to 0.5 mm, but these dimensions may vary. In some embodiments, the LEDs 102 may include multiple chips. The multiple chips can emit light similar or different colors, e.g., red, green, and blue. In addition, different phosphor layers may be applied on different chips on the same submount. The submount may be ceramic or other appropriate material and typically includes electrical contact pads on a bottom surface, which is coupled to contacts on the board 104. Alternatively, electrical bond wires may be used to electrically connect the chips to a mounting board, which in turn is connected to a power supply. Along with electrical contact pads, the LEDs 102 may include thermal contact areas on the bottom surface of the submount through which heat generated by the LED chips can be extracted. The thermal contact areas are coupled to a heat spreading layer on the board 104.

The LEDs 102 can emit different or the same colors, either by direct emission or by phosphor conversion, e.g., where the different phosphor layers are applied to the LEDs. Thus, the illumination device 100 may use any combination of colored LEDs 102, such as red, green, blue, amber, or cyan, or the LEDs 102 may all produce the same color light or may all produce white light. For example, the LEDs 102 may all emit either blue or UV light when used in combination with phosphors (or other wavelength conversion means), which may be, e.g., in or on the window 122 of the output port 120, applied to the inside of the side walls 110, or applied to other components placed inside the cavity (not shown), such that the output light of the illumination device 100 has the color as desired. The phosphors may be chosen from the set denoted by the following chemical formulas: $Y_3Al_5O_{12}$:Ce, (also known as YAG:Ce, or simply YAG) $(Y,Gd)_3Al_5O_{12}$:Ce, CaS:Eu, SrS:Eu, $SrGa_2S4$:Eu, $Ca_3(Sc,Mg)_2Si_3O_{12}$:Ce, $Ca_3Sc_2Si_3O_{12}$:Ce, $Ca_3Sc_2O_4$:Ce, $Ba_3Si_6O_{12}N_2$:Eu, (Sr,Ca) $AlSiN_3$:Eu, $CaAlSiN_3$Eu.

In one embodiment a YAG phosphor is used on the window 122 of the output port 120, and a red emitting phosphor such as $CaAlSiN_3$:Eu, or $(Sr,Ca)AlSiN_3$:Eu is used on the side walls 110 and the reflective plate 106 at the bottom of the cavity 101. By choosing the shape and height of the side walls that define the cavity, and selecting which of the parts in the cavity will be covered with phosphor or not, and by optimization of the layer thickness of the phosphor layer on the window, the color point of the light emitted from the module can be tuned as desired.

Figure 4:
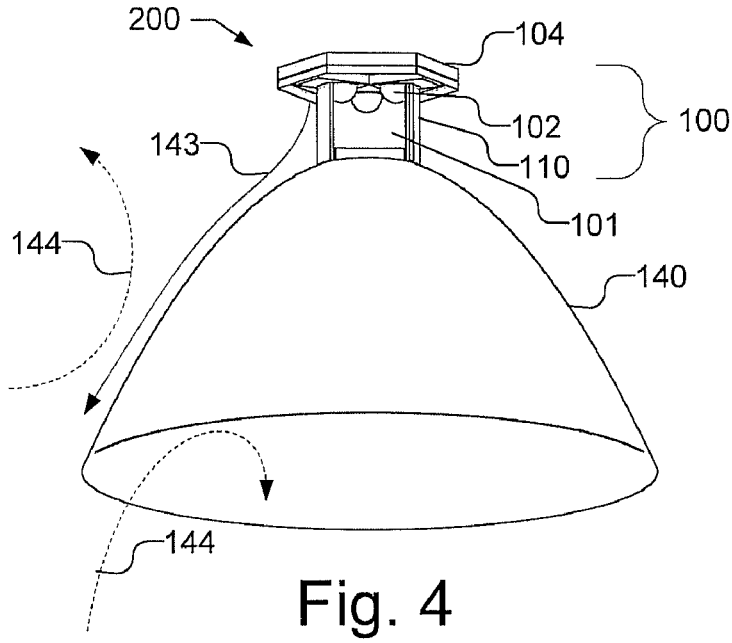
FIG. 4 illustrates a side view of an application of the illumination device in a down light configuration or other similar configuration, such as a spot lamp for task lighting.

FIG. 4 illustrates a side view of an embodiment of a illumination device 200 in a down light configuration or other similar configuration, such as a spot lamp for task lighting. The illumination device 200 includes the device 100, with a portion of the side walls 110 shown cut out so that the LEDs 102 inside the light mixing cavity 101 are visible. As illustrated, the illumination device 200 further includes a reflector 140 for collimating the light that is emitted from the light mixing cavity 101. The reflector 140 may be made out of a thermal conductive material, such as a material that includes aluminum or copper and may be thermally coupled to a heat spreader on the board 104, along with or through the side walls 110. Heat flows through conduction through heat spreaders attached to the board, the thermally conductive side wall, and the thermal conductive reflector 140, as illustrated by arrow 143. Heat also flows via thermal convection over the reflector 140 as illustrated by arrows 144. The heat spreader on the board may be attached to either the light fixture, or to a heat sink, such as heat sink 130, shown in FIG. 3.

Figure 5A:
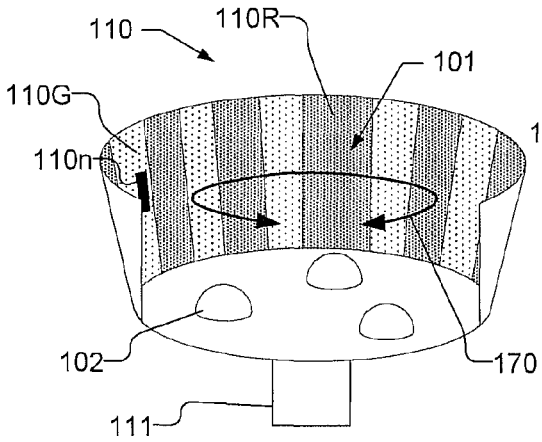
FIGS. 5A and 5B illustrate perspective views of rotatable side walls with patterns of different types of wavelength converting materials.
Figure 5B:
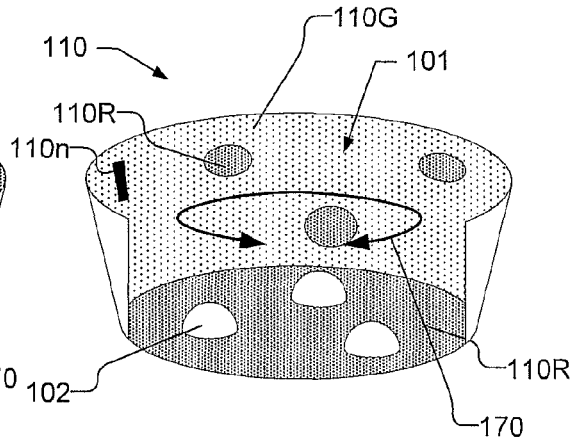

The illumination device includes a movable light adjustment member that is adjustable to alter the shape or color of the light produced by the light emitting device. FIGS. 5A and 5B illustrate perspective views of the side walls 110 with the side walls 110 partially cut-away to show a view inside of the cavity 101 having patterns of different types of wavelength converting materials, e.g., a red phosphor and a green phosphor. In one embodiment, the illumination device 100 may include different types of phosphors that are located at different areas of the light mixing cavity 101. For example, red and green phosphors may be located on the side walls 110 or the board 104 and a yellow phosphor may be located on the top or bottom surfaces of the window or embedded within the window. As illustrated, the different types of phosphors, e.g., red and green, may be located on different areas on the sidewalls 110. For example, one type of phosphor 110R may be patterned on the sidewalls 110 at a first area, e.g., in stripes, spots, or other patterns, while another type of phosphor 110G is located on a different second area of the sidewall. If desired, additional phosphors may be used and located in different areas in the cavity 101.

The side walls 110 with the different patterns of phosphors may be rotatable, as illustrated by arrow 170. By rotating the side walls 110, the different phosphors may be more or less directly exposed to the light from the LEDs 102, thereby configuring the mixing cavity 101 to produce the desired light color point. Accordingly, by rotating the side walls 110, the illumination device 100 can be controlled to vary and set the desired color point.

The rotation of the side walls 110 may be controlled manually or with an actuator 111 under the illumination device 100. For example, the side walls 110 may include notches 110*n* that can be pushed, e.g., with a finger or tool, to rotate the side walls 110. Alternatively, an exposed gear may be used to rotate the side walls 110. The side walls 110 may be rotated during normal operation or during manufacturing, before clamping or gluing the side wall.

Figure 6:
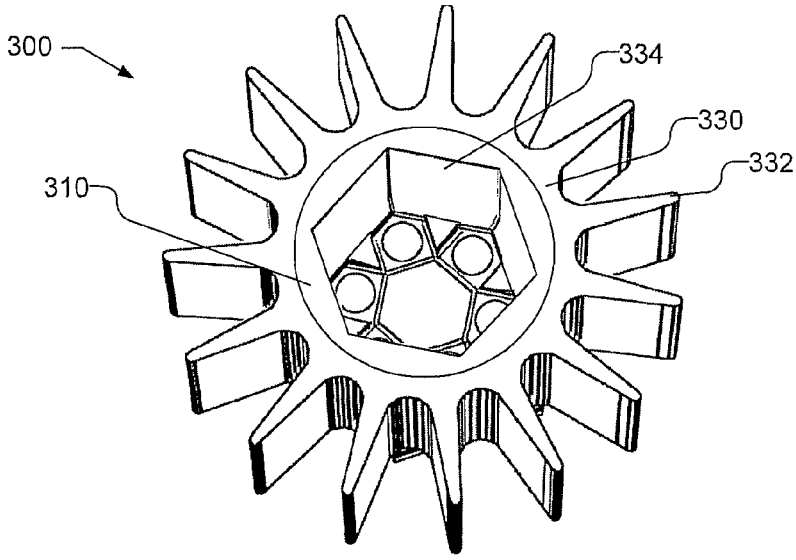
FIG. 6 illustrates a top perspective views of a illumination device with a heat sink having radial fins and an optically reflective hexagonal cavity in the center in which rotatable side walls may be placed.

By way of example, the side walls 110 may be rotated with respect to a surrounding heat sink, as illustrated in FIG. 6, which shows a top perspective views of a illumination device 300 with a heat sink 330 having radial fins 332 and an optically reflective hexagonal cavity 334 in the center. The heat sink 330 may be extruded, casted, molded, machined or otherwise manufactured from a thermally conductive material, such as aluminum. In one embodiment, rotatable side walls 310' may be inserted into the center cavity 334 of the heat sink 330 and rotated to a desired position.

Figure 7A:
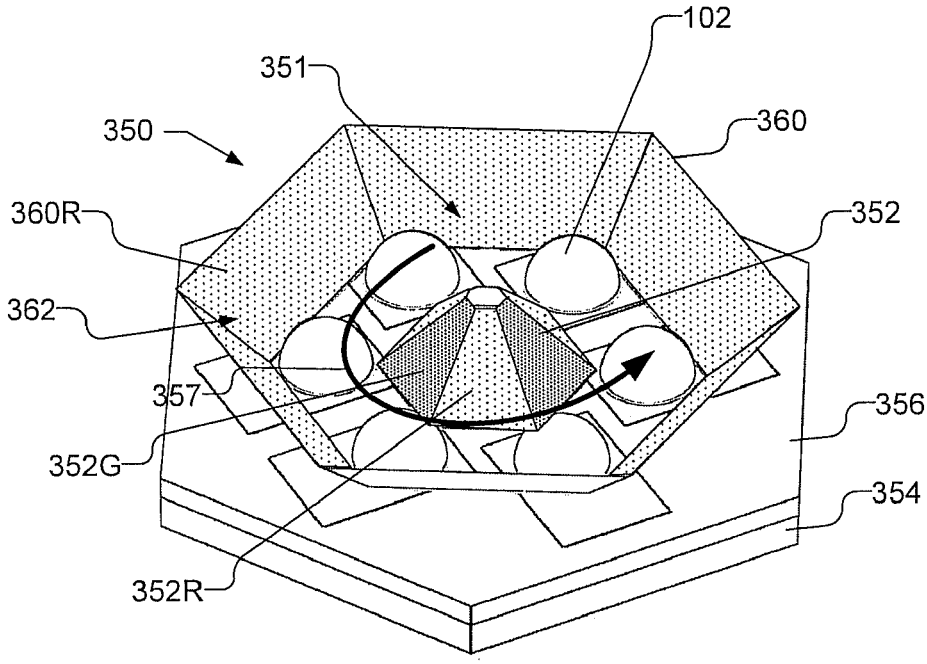
FIG. 7A illustrates a perspective view of another embodiment of a illumination device with a hexagonal shaped rotatable central reflector.

FIG. 7A illustrates a perspective view of another embodiment of a illumination device 350, with a central reflector 352 and reflective side walls 360 that have a hexagonal configuration that is tapered so that the distance between opposite side walls is less at the bottom of the side walls, i.e., at the reflective plate 356, then at the top of the side walls, i.e., at the output port 362. If desired, the side walls 360 may not be tapered. The central reflector 352 includes different types of wavelength converting materials 352R and 352G, e.g., different types of phosphors, and the side walls 360 are illustrated as also being covered with a wavelength converting material 360R. Moreover, central reflector 352 is rotatable around a central axis, as illustrated by arrows 357, which may be controlled manually or with an actuator under the illumination device 350, similar to that shown in FIG. 5A. By rotating the central reflector 352, the different phosphors may be more or less directly exposed to the light from the LEDs 102, thereby configuring the mixing cavity to produce the desired light color point. Accordingly, by rotating the central reflector 352 the illumination device 350 can be controlled to vary and set the desired color point.

The central reflector 352 is also shown with a tapered hexagonal configuration, which is useful to redirect light emitted into large angles from the LEDs 102 into narrower angles with respect to normal to the board 354. In other words, light emitted by LEDs 102 that is close to parallel to the board 354 is redirected upwards toward the output port 362 so that the light emitted by the illumination device has a smaller cone angle compared to the cone angle of the light emitted by the LEDs directly. By reflecting the light into narrower angles, the illumination device 350 can be used in applications where light having large angles is to be avoided, for example, due to glare issues (office lighting, general lighting,), or due to efficiency reasons where it is desirable to send light only where it is needed and most effective (task lighting, under cabinet lighting.) Moreover, the efficiency of light extraction is improved for the illumination device 350 as light emitted in large angles undergoes less reflections in the light mixing cavity 351 before reaching the output port 362 compared to a device without the central reflector 352. This is particularly advantageous when used in combination with a light tunnel or integrator, as it is beneficial to limit the flux in large angles due to light being bounced around much more often in the mixing cavity, thus reducing efficiency. The reflective plate 356 on the board 354 may be used as an additional heat spreader.

Figure 7B:
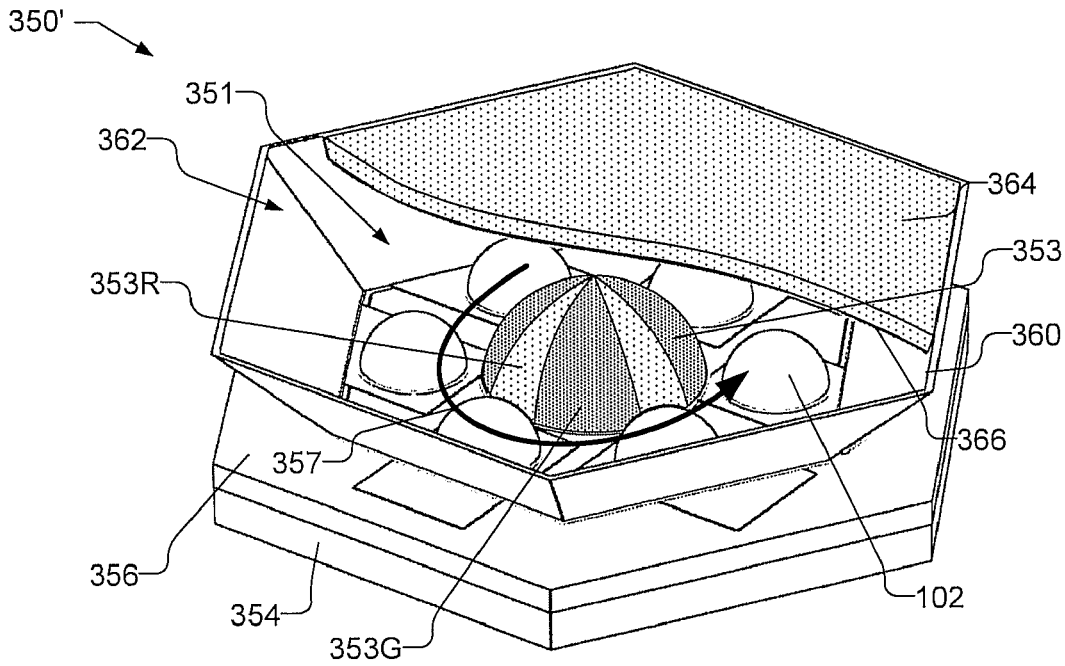
FIG. 7B illustrates a perspective view of another embodiment of a illumination device with a dome shaped rotatable central reflector.

FIG. 7B illustrates another embodiment of a illumination device 350' that is similar to illumination device 350 shown in FIG. 7A, but has a central reflector 353 that has a dome shape that is configured to distribute the light from the LEDs 102 over the output port 362 and is shown with a window 364, which may act as a diffuser, over the output port 362. If desired, the illumination device 350 in FIG. 7A may include a window 364. As with central reflector 352 described above, the dome shaped central reflector 353 includes different types of wavelength converting materials 353R and 353G, and is rotatable around a central axis, as illustrated by arrows 357, which may be controlled manually or with an actuator under the illumination device 350', similar to actuator 111 shown in FIG. 5A. Rotation of the central reflector 353 exposes the different phosphors more or less directly to the light from the LEDs 102, thereby configuring the mixing cavity to produce the desired light color point. The dome reflector 353 may have either diffuse or mirror like reflective properties. The window 364 may include one or more wavelength converting materials. A dichroic mirror 366 layer may be coupled to the window 364 between the LEDs 102 and the phosphor in or on the window 364. The dichroic mirror 366 may be configured to reflect and transmit desired wavelengths to produce the desired color temperatures, e.g., for warm temperatures, the dichroic mirror 366 may reflect blue light and for cooler color temperatures, the dichroic mirror 366 transmits more blue light.

Figure 8A:
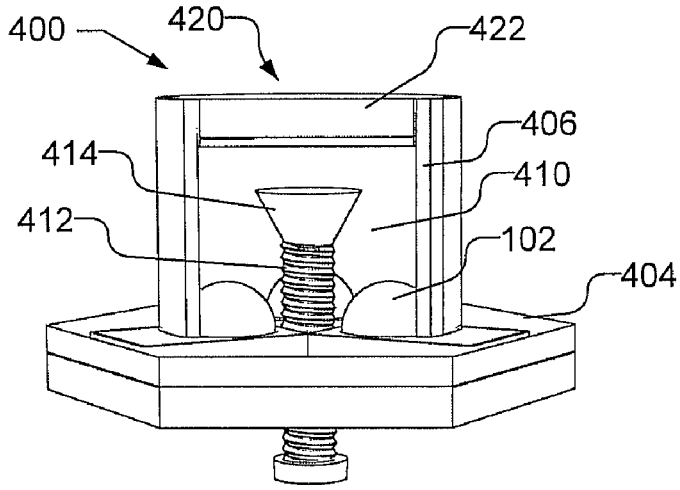
FIGS. 8A and 8B illustrate perspective views of another illumination device with a configurable mixing cavity.
Figure 8B:
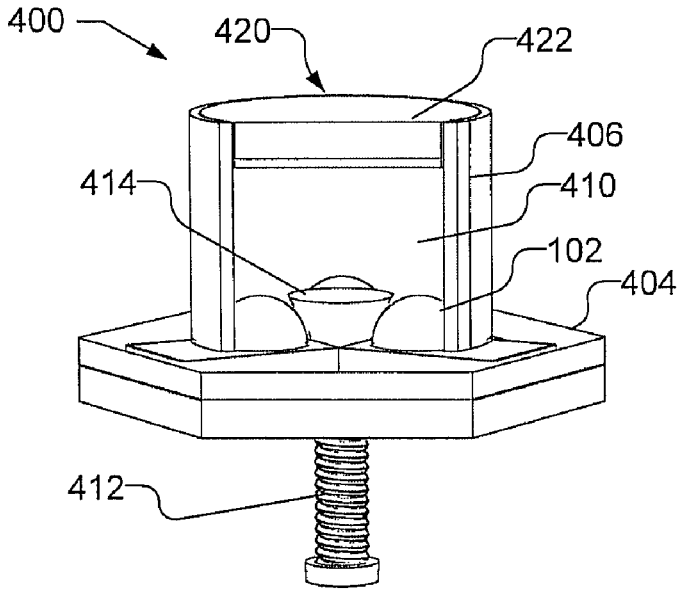

FIGS. 8A and 8B illustrate perspective views of another illumination device 400, which is similar to illumination device 100, shown in FIGS. 1 and 2, but includes a configurable mixing cavity 410 that is configurable to change the light distribution and/or color of the light emitted from the illumination device 400. Illumination device 400 includes an adjustment member, such as a screw 412 through the configurable mixing cavity 410 that is adjustable to produce the desired optical affects. The screw 412 includes a head 414 that may be configured with different shapes or sizes to produce the desired affect. The head 414 and/or the entire screw 412 that enters the configurable mixing cavity 410 may be made of highly reflective material, and may be diffuse or specular reflecting. Additionally, the head 414 and/or the entire screw 412 may also be coated with one or more phosphors.

The illumination device 400 may include side walls 406 that are covered on the inside surface with a layer of one or more phosphors. The illumination device 400 includes an output port 420 that may be open or may include a window 422. If a window 422 is used, it may include an optional diffuser, and/or a phosphor layer, or an optical microstructure.

The screw 412 may enter the configurable mixing cavity 410 of the illumination device 400 from the bottom, i.e., through the board 404, and is adjustable, i.e., can be raised or lowered as illustrated in FIGS. 8A and 8B, respectively, to change the optical properties of the mixing cavity 410. By way of example, the beam pattern coming from the mixing cavity 410 may be changed, or the color of the light emitted from the top of the illumination device 400 may be changed. To achieve the color change effect, phosphors or absorbing color filters may be used. These phosphors or color filters can be located on the head 414 and/or the screw 412 itself, on the side walls 406 or the window 422. By changing the position of the screw different phosphors are exposed to different amounts and colors of light, thereby producing a different color at the output port.

Figure 9A:
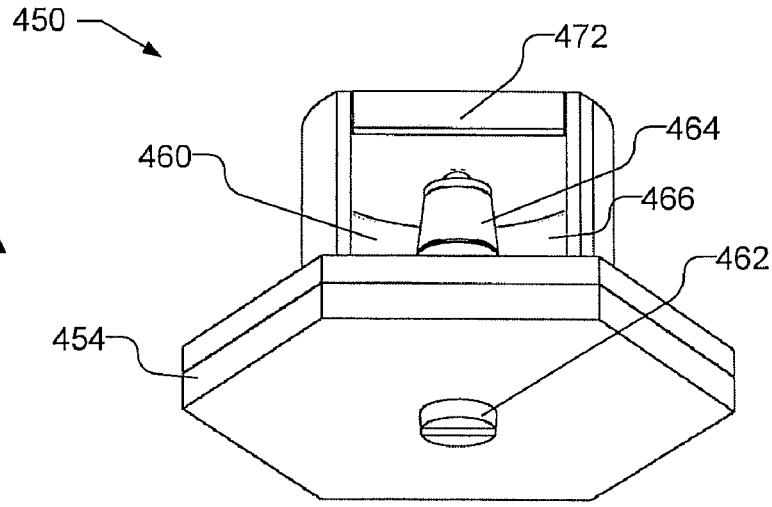
FIG. 9A illustrates a bottom cut-away perspective view.
Figure 9B:
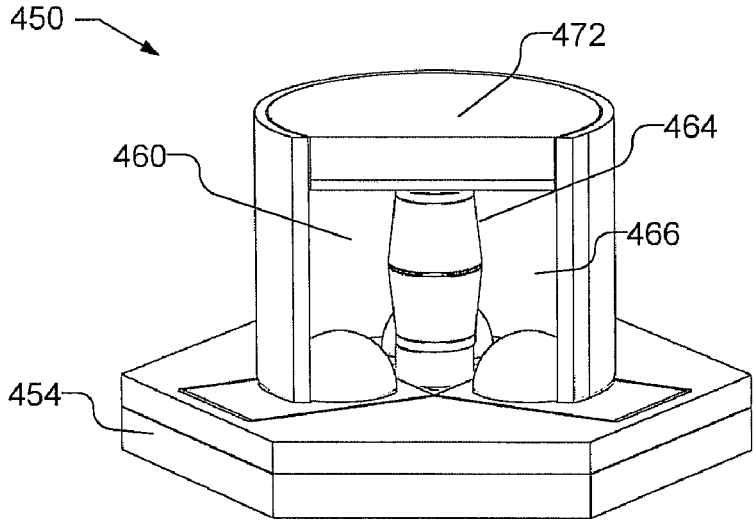
FIGS. 9B and 9C illustrate top cut-away perspective views of another illumination device with a configurable mixing cavity.
Figure 9C:
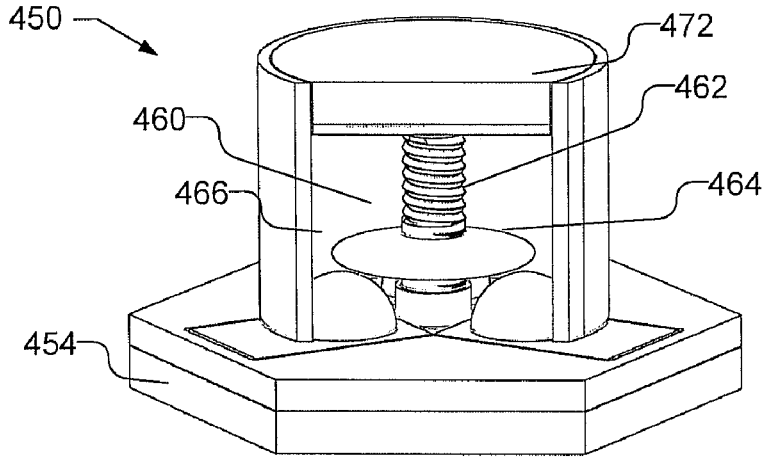

FIG. 9A illustrates a bottom cut-away perspective view, and FIGS. 9B and 9C illustrate top cut-away perspective views of another illumination device 450, which is similar to illumination device 400, with a configurable mixing cavity 460 to adjust the light distribution and/or color of the light emitted from the illumination device 450. Illumination device 450 includes a different adjustable member in the form of a screw 462 that extends through the configurable mixing cavity 460, but unlike with illumination device 400, the screw 462 remains inside the configurable mixing cavity 460. By way of example, the screw may be rotationally fixed between the board 454 and the window 472. A flexible structure 464 is coupled to the screw so that the shape of the flexible structure 464 changes when the screw 462 is rotated. For example, the bottom of the flexible structure 464 may be held stationary while the top of the flexible structure 464 is threadedly engaged with the screw 462 so that rotation of the screw expands the flexible structure 464 into a cylindrical configuration or contracts the flexible structure 464 into a disk like configuration as illustrated in FIGS. 9B and 9C, respectively. As illustrated in FIG. 9A, the bottom of the screw 462 may include exposed outside the illumination device 450 so that the screw can be manually or automatically adjusted.

The flexible structure 464 may be made of a flexible material, such as rubber, silicone or plastic and may contain phosphors and/or white scattering particles. By changing the shape of the flexible structure 464, the optical properties of the mixing cavity 460 are changed and can be used to change the light distribution or the color of the light output. In a similar embodiment, the flexible structure 464 may be shaped and operate like an umbrella. The umbrella may be made of a translucent material and contain a wavelength converting material like phosphor, which may be, e.g., a red phosphor.

In another embodiment, instead of flexible structure 464, the side walls 466 themselves may be flexible and change shape to alter exposure of different phosphors on the side walls 466 to the light produced by the LEDs 102.

Figure 10A:
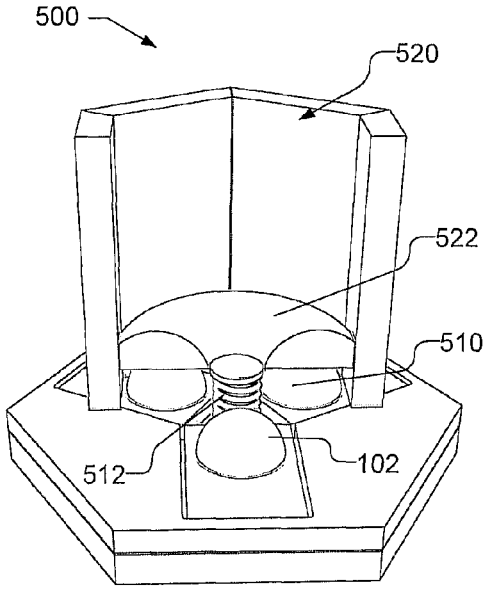
FIGS. 10A and 10B illustrate cut-away perspective views of another illumination device with a configurable mixing cavity.
Figure 10B:
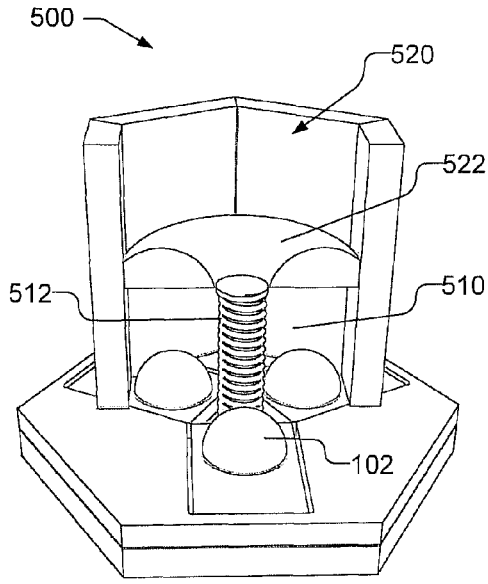

FIGS. 10A and 10B illustrate cut-away perspective views of another embodiment of a illumination device 500 with a configurable mixing cavity 510. The illumination device 500 includes another adjustable member in the form of a screw 512 that can be used to adjust the position of a lens 522 at the output port 520 of the illumination device 500. By adjusting the position of the lens 522, the resulting light output from the illumination device 500 can be changed from a narrow beam to a wide beam. The lens 522 is illustrated as a donut type lens that may be placed very close to the LEDs 102. In some embodiments, other types of lenses may be used, such as a Fresnel lens or a non-imaging TIR type, such as that made by Polymer Optics, Ltd. The lens 522 is configured to collimate the light when at one position, e.g., when the lens is close to the LEDs 102, as illustrated in FIG. 10A, but may disperse the light when moved away from the LEDs 102 (via rotation of the screw 512) as illustrated in FIG. 10B.

Figure 10C:
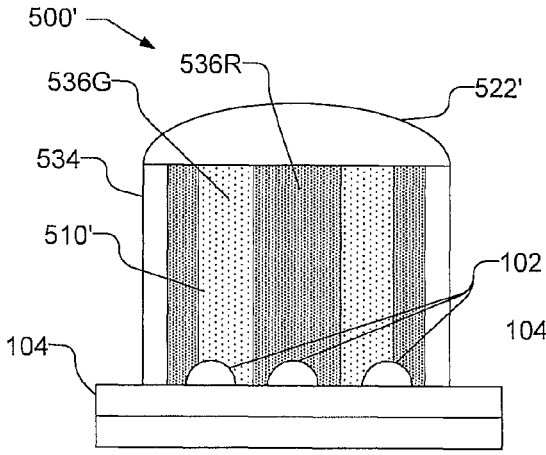
FIGS. 10C and 10D illustrate cut-away side views of another illumination device with a configurable mixing cavity.
Figure 10D:
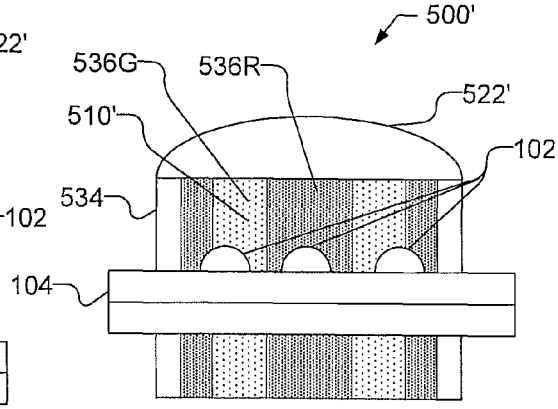

FIGS. 10C and 10D illustrate a cut-away view of another embodiment of a illumination device 500' with a configurable mixing cavity 510' that is similar to that shown in FIGS. 10A and 10B. The illumination device 500' includes an adjustable member in the form of a lens 522' coupled to the side walls 534, where the distance between the lens 522' and the LEDs 102 is adjusted by raising or lowering then lens 522' as illustrated in FIGS. 10C and 10D, respectively. By adjusting the vertical position of the side walls 534 with respect to the LEDs 102, the position of the lens 522' is altered and the resulting light output from the illumination device 500' can be changed from a narrow beam to a wide beam. The lens 522' may have various configurations as desired, including a Fresnel lens or a non-imaging TIR type, such as that made by Polymer Optics, Ltd. The lens 522' may collimate the light when at one position, e.g., when the lens 522' is close to the LEDs 102, as illustrated in FIG. 10D, but may disperse the light when moved away from the LEDs 102 as illustrated in FIG. 10C. Additionally, the side walls 534 may include one or more wavelength converting materials 536R and 536G and the LEDs 102 may have a cool white color temperature. The color temperature of the light produced by the illumination device 500' may be tuned by, e.g., rotating the side walls 534 with respect to the LEDs 102. Alternatively, the composition of the wavelength converting material, e.g., the concentration, density or types of a wavelength converting materials may vary as a function of vertical position on the side walls 534 and thus, the color temperature of the light produced by the illumination device 500' may be controlled by raising or lowering the lens 522'. It should also be understood that FIGS. 10C and 10D illustrate the lens 522' being raised and lowered with respect to the LEDs 102 by moving the side walls 534, if desired, the LEDs 102, including at least a portion of the board 104 may be raised and lowered with respect to the lens 522'.

Figure 11A:
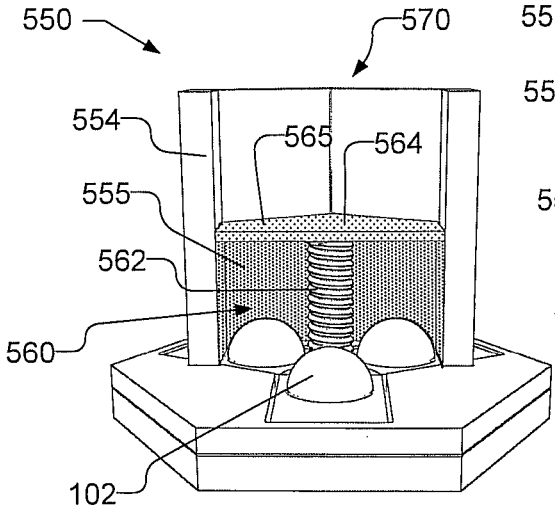
FIGS. 11A and 11B illustrate cut-away perspective views of another illumination device with a configurable mixing cavity, using at least one phosphor material on the sidewalls, or on a transparent top plate.
Figure 11B:
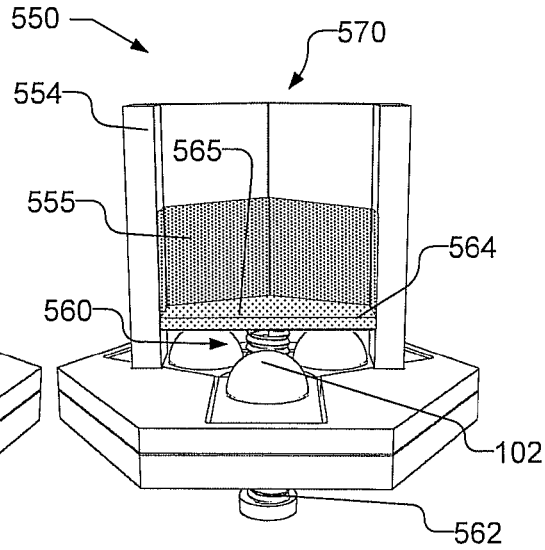

FIGS. 11A and 11B illustrate cut-away perspective views of another embodiment of a illumination device 550 with a configurable mixing cavity 560. The illumination device 550 includes an adjustable member in the form of a movable translucent window 564 that can be positioned at different heights from the LEDs 102 via a screw 562 or other appropriate device, such as a simple rod or adjustable ratchet element. By changing the height of the translucent window 564 within the center section 560, the color or the light distribution properties of the light out of the module can be changed.

In one embodiment, the bottom section of the side walls 554 are coated or impregnated with a phosphor material 555 and the translucent window 564 is coated or impregnated with a different type of phosphor material 565. For example, a red emitting phosphor may be applied to the bottom section of the side walls 554 while a yellow emitting phosphor is applied to the translucent window 564 or vice versa. In this embodiment, blue emitting LEDs 102 are used. Phosphors such as YAG, and NitridoSilicate red and amber phosphors have a high excitation efficiency for blue and UV light, which means that a blue photon has a high probability of being converted into a red or yellow photon. For longer wavelength light, such as cyan or yellow, this probability is reduced and instead of the photon being converted, the photon is only scattered.

Thus, when the translucent window 564 is in its lowest position (FIG. 11B), most of the blue emitted light is received by the translucent window 564 is converted into yellow light and the red emitting phosphor on the side walls 554 converts little of the light. The yellow light hits the red phosphor on the side walls 554, which converts little or none of the yellow photons into red photons, and some of the remaining blue photons into red photons. In this configuration mainly yellow and blue light is generated, which means that light with a high color temperature is produced at the output port 570 of the illumination device.

When the translucent window 564 is in its highest position (FIG. 11A), blue photons emitted from the LEDs 102 are incident on the side walls 554 with the red converting phosphor, and the translucent window 564 with the yellow converting phosphor. After conversion to red light, the red photons are not converted by the yellow phosphor on the translucent window 564, but are mainly transmitted and/or scattered by the translucent window 564. Thus, in the configuration shown in FIG. 11A, more red is produced and the light at the output port 570 will have a much lower color temperature. Of course, the translucent window 564 can be positioned in any desired position between the top and bottom positions shown in FIGS. 11A and 11B to achieve the desired color temperature. Moreover, different types of phosphors may be used and located in different patterns. For example, different portions of the side wall 554 may be covered with different types of phosphors with varying configurations. For example, the phosphors may have a striped configuration that is wider near the bottom of the side wall 554, i.e., near the LEDs, for one type of phosphor and narrow for the other type of phosphor. Thus, as the position of the window 564 is adjusted in height, the phosphors will be exposed to light within the cavity 560 in different ratios.

Figure 12A:
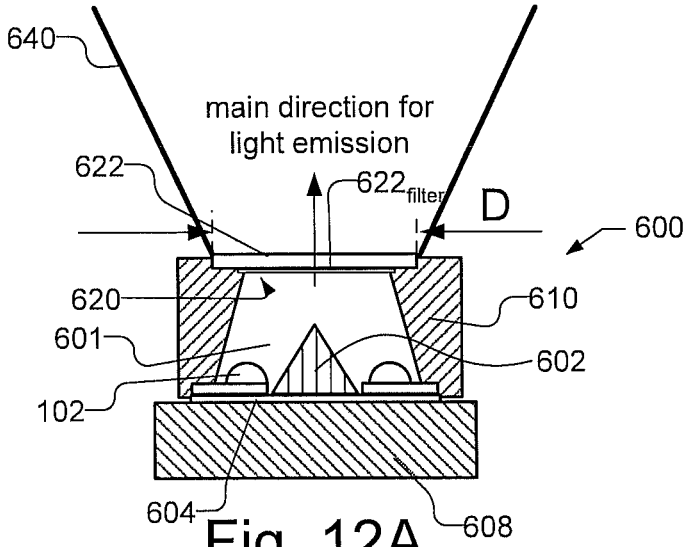
FIG. 12A illustrates a cross sectional view and FIGS. 12B and 12C illustrate top plan views of another illumination device.
Figure 12B:
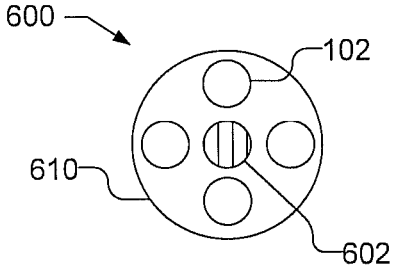
Figure 12C:
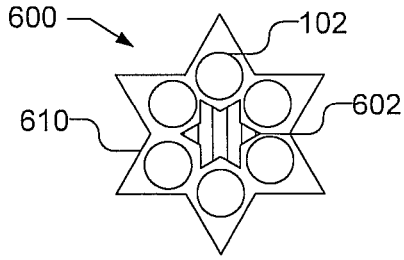

FIG. 12A illustrates a cross sectional view of another embodiment of a illumination device 600, similar to illumination device 100, shown in FIGS. 1 and 2. Illumination device 600 is illustrated with LEDs 102 mounted on a board 604 that is mounted on a heat sink 608. Additionally, side walls 610 are shown as tapered so that the cross-sectional area of the cavity 601 at the bottom, e.g., near to the LEDs 102, is greater than the cross-sectional area of the cavity 601 at the top, e.g., near the output port 620. As with illumination device 100, the side walls 610 of illumination device 600 may define a cavity 601 with a continuous shape, e.g., circular (elliptical) as illustrated in FIG. 12B or a non-continuous polygonal shape, as illustrated in FIG. 12C, or a combination thereof.

Illumination device 600 may further include a diverter 602, which may be placed centrally in the cavity 601, and which may be rotatable as discussed in reference to FIGS. 7A and 7B. The use of this diverter 602 helps to improve the efficiency of the illumination device 600 by redirecting light from the LEDs 102 towards the window 622. In FIG. 12A the diverter 602 is illustrated as having a cone shape, but alternative shapes may be used if desired, for example, a half dome shape, or a spherical cap, or aspherical reflector shapes. Moreover as illustrated in FIGS. 12B and 12C, the diverter 602 may have various shapes in plan view. The diverter 602 can have a specular reflective coating, a diffuse coating, or can be coated with one or more phosphors. The height of the diverter 602 may be smaller than the height of the cavity 601 (e.g., approximately half the height of the cavity 601) so that there is a small space between the top of the diverter 602, and the window 622.

In one embodiment, a YAG phosphor is used on the window 622, and a red emitting phosphor such as $CaAlSiN_3$:Eu, or $(Sr,Ca)AlSiN_3$:Eu is used on the side walls 610 and the board 604 at the bottom of the cavity 601. By choosing the shape of the side of the cavity, and selecting which of the parts in the cavity will be covered with phosphor or not, and by optimization of the layer thickness of the phosphor layer on the window, the color point of the light emitted from the module can be tuned to the color as desired by the customers.

In one embodiment, a blue filter $\mathbf{622}_{filter}$ may be coupled to the window 622 to prevent too much blue light from being emitted from the illumination device 600. The blue filter $\mathbf{622}_{filter}$ may be an absorbing type or a dichroic type, with no or very little absorption. In one embodiment, the filter $\mathbf{622}_{filter}$ has a transmission of 5% to 30% for blue, while a very high transmission (greater than 80%, and more particularly 90% or more) for light with longer wavelengths.

Figure 13A:
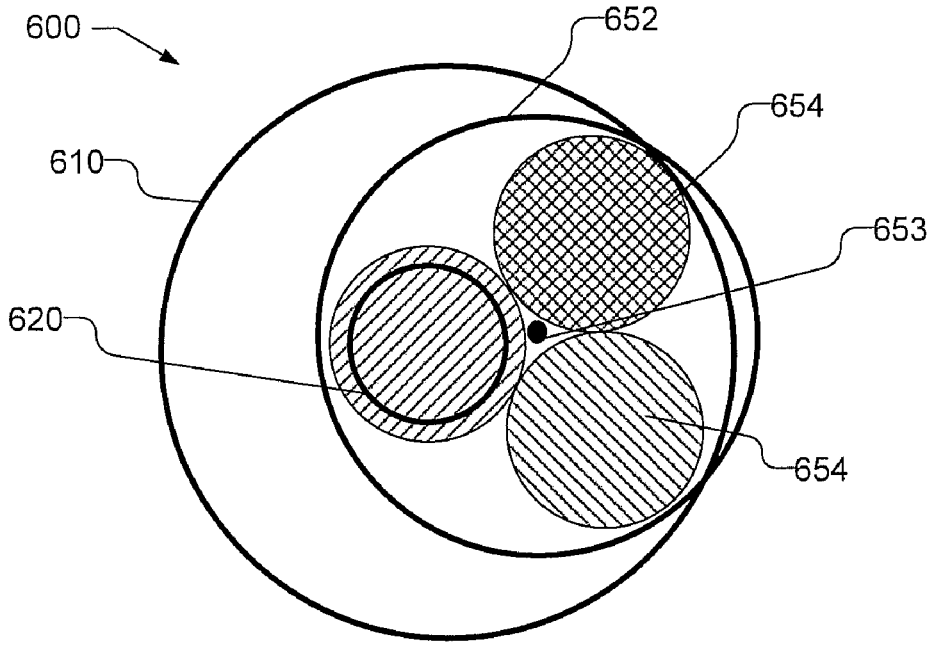
FIGS. 13A and 13B illustrate top and side views, respectively, of a illumination device with a rotating color selection plate.
Figure 13B:
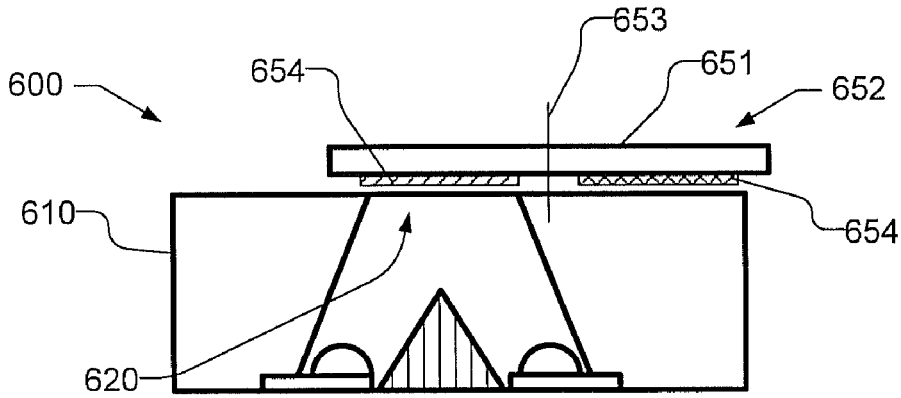

FIGS. 13A and 13B illustrate a top view and side view, respectively, of an embodiment of the illumination device 600 in which a large disk acts as a rotating color selection plate 652 and is mounted on top of the illumination device 600. The color selection plate 652 may be used along with or in the alternative to the window 622. The color selection plate 652 can be rotated about an axis 653 such that different areas 654 of the plate 652 can be placed in front of the output port 620. The color selection plate 652 uses different wavelength converting material compositions, such as different concentrations of a wavelength converting material, different densities of wavelength converting material and different wavelength converting materials. By way of example, color selection plate 652 illustrates different phosphor patterns and combinations in the different areas 654 of the plate 652 to achieve different color points. The color selection plate 652 shown in FIG. 13A has three distinct areas 654 with phosphor patterns, but the plate 652 can be configured such that the color changes gradually going from one orientation to the other. More or fewer distinct areas with phosphor patterns may be used if desired.

Figure 15:
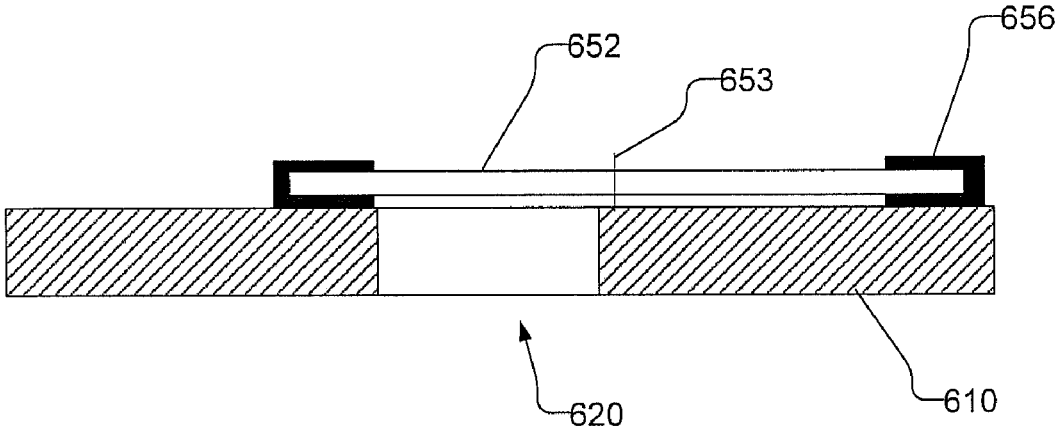
FIG. 15 is a cross-sectional view of a movable color selection plate in contact with the illumination device.

The color selection plate 652 may be produced using a substrate 651 that has a high thermal conductivity, such as aluminum oxide, which can be used in its crystalline form (Sapphire), as well in its poly-crystalline or ceramic form, called Alumina, with the areas 654 patterned with a phosphor layer. The plate 652 may be placed in thermal contact with a heat-sink, such as the side walls 610 or heat sink 608 (shown in FIG. 12A). This is done, for example, by mounting the color selection plate 652 in an aluminum or copper frame 656 that has a polished surface on the side that contacts the heat-sink, and has a polished surface on top of the heat-sink as well, as illustrated in FIG. 15.

Figure 14A:
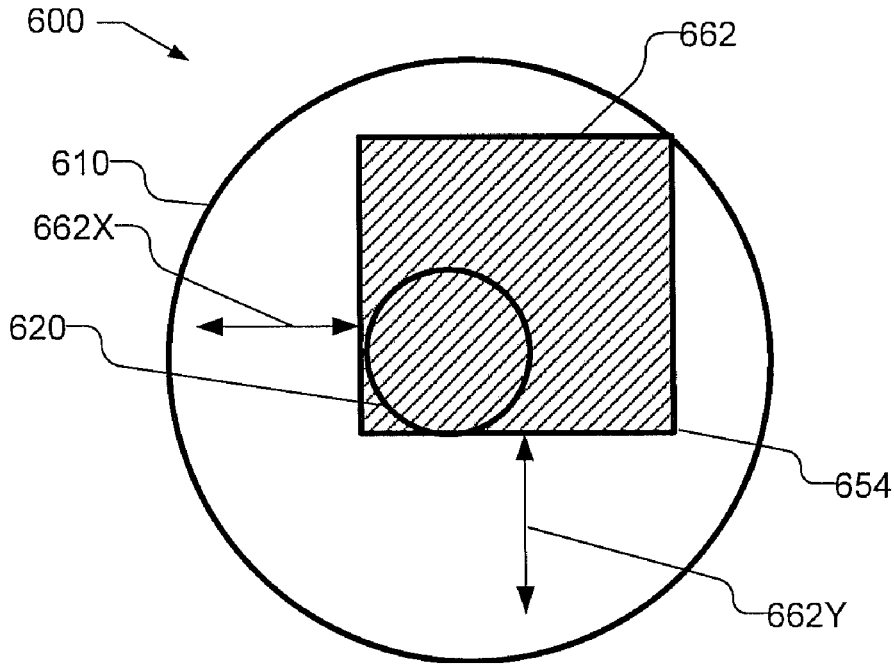
FIGS. 14A and 14B illustrate top and side views, respectively, of a illumination device with a slideable color selection plate.
Figure 14B:
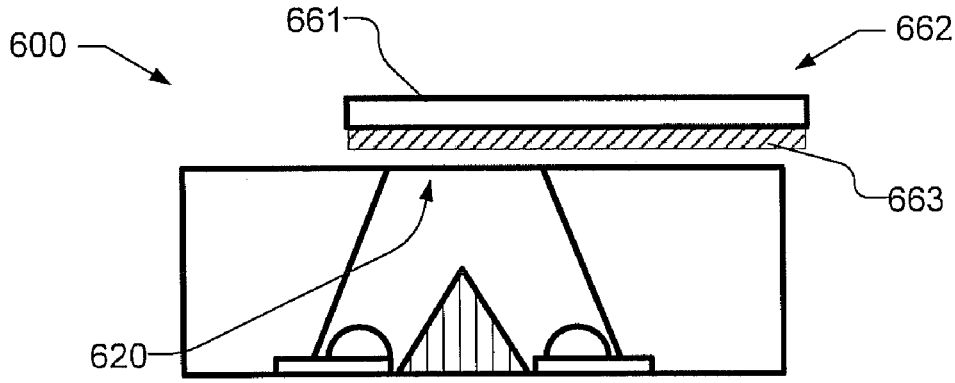

FIGS. 14A and 14B illustrate a top view and side view, respectively, of another embodiment of the illumination device 600 in which a slideable color selection plate 662 that is slideably mounted on top of the illumination device 600. The slideable color selection plate 662 may also use different wavelength converting material compositions, such as different concentrations of a wavelength converting material, different densities of wavelength converting material and different wavelength converting materials. By way of example, color selection plate 662 may have a gradual change in phosphors in the x direction (662X) and the y direction (662Y). The color selection plate 662 may be movable manually or electromagnetically. Thus, by moving the plate 662 in different directions, different areas of the plate 662 may be over the output port 620 of the illumination device 600 to achieve a light output with different colors. If desired, the color selection plate 662 may have distinct areas with different phosphors, rather than a gradual change.

As with the color selection plate 652 in FIGS. 13A and 13B, the color selection plate 662 may be produced using a substrate 661 that has a high thermal conductivity, such as aluminum oxide, with the changing phosphor layer 663 deposited on the substrate 661. The gradually changing phosphor layer 663 may be produced by screen printing using at least two different screens with different patterns. Additionally, the plate 662 may be placed in thermal contact with a heat-sink, such as the side walls 610 or heat sink 608 (shown in FIG. 12A) as described above in reference to FIGS. 13A and 13B.

Although the present invention is illustrated in connection with specific embodiments for instructional purposes, the present invention is not limited thereto. It should be understood that the embodiments described herein may use any desired wavelength converting materials, including dyes, and are not limited to the use of phosphors. Additionally, it should be understood that aspects of the illumination device described in the various figures may be combined in various manners. Various adaptations and modifications may be made without departing from the scope of the invention. Therefore, the spirit and scope of the appended claims should not be limited to the foregoing description.

What is claimed is:

1. An light emitting diode illumination device comprising:

a board;

at least one light emitting diode mounted on the board;

at least one reflective sidewall coupled to the board and configured to surround the at least one light emitting diode, the at least one reflective sidewall defines a light mixing cavity;

an output port through which light within the light mixing cavity is transmitted; and a color selection plate movably coupled to the at least one reflective sidewall and covering the output port, the color selection plate comprising a substrate having a plurality of areas with different wavelength converting material compositions, wherein the color selection plate is movable to align a selected one of the plurality of areas with the output port to change a color of the light transmitted through the output port.

2. The light emitting diode illumination device of claim 1, wherein the at least one light emitting diode comprises at least one packaged light emitting diode.

3. The light emitting diode illumination device of claim 1, wherein the color selection plate rotates about an axis to position the selected one of the plurality of areas over the output port.

4. The light emitting diode illumination device of claim 1, wherein the color selection plate slides to position the selected one of the plurality of areas over the output port.

5. The light emitting diode illumination device of claim 1, wherein the plurality of areas are separated.

6. The light emitting diode illumination device of claim 1, wherein the plurality of areas are continuously connected.

7. The light emitting diode illumination device of claim 1, wherein the color selection plate is thermally coupled to a heat sink

8. The light emitting diode illumination device of claim 1, wherein the different wavelength converting material compositions comprises different concentrations of a wavelength converting material, different densities of wavelength converting material and different wavelength converting materials.

9. A light emitting diode illumination device comprising:

a light mixing cavity configured to surround at least one light emitting diode such that light emitted from the at least one light emitting diode directly enters the light mixing cavity, the light mixing cavity comprising a top surface area, a bottom surface area, and a side surface area;

a first type of wavelength converting material covering a first wavelength converting area of the light mixing cavity; and a moveable color adjustment member positioned to alter exposure of the first wavelength converting area to the light emitted from the at least one light emitting diode, wherein the moveable color adjustment member is positioned in one of a center of the light mixing cavity extending towards an output port, and around a perimeter of the light mixing cavity.

10. The light emitting diode illumination device of claim 9, wherein the top is an output port through which light within the light mixing cavity is transmitted.

11. The light emitting diode illumination device of claim 9, wherein the side surface area is reflective and includes the first type of wavelength conversion material.

12. The light emitting diode illumination device of claim 9, wherein the moveable color adjustment member includes the first type of wavelength converting material.

13. The light emitting diode illumination device of claim 9, wherein the moveable color adjustment member includes a second type of wavelength converting material.

14. The light emitting diode illumination device of claim 9, wherein the moveable color adjustment member includes a second wavelength converting area different from the first wavelength converting area, the second wavelength converting area including a second wavelength converting material.

15. The light emitting diode illumination device of claim 9, wherein the moveable color adjustment member is rotatable relative to the at least one light emitting diode.

16. The light emitting diode illumination device of claim 9, wherein the moveable color adjustment member has one of a conical and a dome shape.

17. A method comprising:

collecting an amount of light emitted from at least one light emitting diode into a light mixing cavity, the light mixing cavity configured to surround the at least one light emitting diode such that the amount of light emitted from the at least one light emitting diode directly enters the light mixing cavity, the light mixing cavity comprising a top surface area, a bottom surface area, and a side surface area, a first type of wavelength converting material covering a first wavelength converting area of the light mixing cavity;

positioning a movable color adjustment member relative to the at least one light emitting diode to alter exposure of the first wavelength converting area to light emitted from the at least one light emitting diode, wherein the moveable color adjustment member is positioned in one of a center of the light mixing cavity extending towards an output port, and around a perimeter of the light mixing cavity; and transmitting light from the light mixing cavity through an output port of the light mixing cavity.

* * * * *